US010112086B2

(12) United States Patent
Kultala et al.

(10) Patent No.: US 10,112,086 B2
(45) Date of Patent: Oct. 30, 2018

(54) ASCENDING WEIGHT IRON SHAFT SYSTEM

(71) Applicant: KARSTEN MANUFACTURING CORPORATION, Phoenix, AZ (US)

(72) Inventors: David Kultala, Phoenix, AZ (US); Martin Jertson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 229 days.

(21) Appl. No.: 15/069,731

(22) Filed: Mar. 14, 2016

(65) Prior Publication Data

US 2017/0065860 A1 Mar. 9, 2017

Related U.S. Application Data

(60) Provisional application No. 62/135,301, filed on Mar. 19, 2015, provisional application No. 62/141,116, filed on Mar. 31, 2015.

(51) Int. Cl.

| | |
|---|---|
| ***A63B 53/12*** | (2015.01) |
| ***A63B 53/10*** | (2015.01) |
| ***A63B 53/00*** | (2015.01) |
| *A63B 60/24* | (2015.01) |

(52) U.S. Cl.

CPC ..... *A63B 53/12* (2013.01); *A63B 53/00* (2013.01); *A63B 53/10* (2013.01); *A63B 60/24* (2015.10); *A63B 2053/005* (2013.01)

(58) Field of Classification Search

CPC ..... A63B 60/24; A63B 53/00; A63B 53/12; A63B 53/10; A63B 2053/005

See application file for complete search history.

(56) References Cited

U.S. PATENT DOCUMENTS

| | | | |
|---|---|---|---|
| 1,713,812 | A | 5/1929 | Barnhart |
| 2,086,275 | A | 7/1937 | Lemmon |
| 4,123,055 | A | 10/1978 | Brill |
| 5,685,783 | A | 11/1997 | Akatsuka et al. |
| 5,755,826 | A | 5/1998 | Beach et al. |
| 5,882,268 | A | 3/1999 | McIntosh et al. |
| 5,904,627 | A | 5/1999 | Miyaji et al. |
| 5,924,936 | A | 7/1999 | Penley |
| 5,935,017 | A | 8/1999 | Weaver et al. |
| 6,017,279 | A | 1/2000 | Sumitomo |
| 6,117,021 | A | 9/2000 | Crow et al. |

(Continued)

FOREIGN PATENT DOCUMENTS

| | | | |
|---|---|---|---|
| JP | H02-102682 | A | 4/1990 |
| JP | H02102682 | A | 4/1990 |

(Continued)

OTHER PUBLICATIONS

"Mixing up steel and graphite?" (SNORKLE) 2010. [online] [retrieved on May 12, 2016]. Retrieved from: https://answers.yahoo.com/question/index?qid=20091225144835AA VRZpC.

(Continued)

*Primary Examiner* — John C Hong

(57) ABSTRACT

Described herein is a system of golf clubs having shafts with ascending weights (shaft weights that increase as shaft lengths decrease). The system of golf clubs can be manufactured by implementing a method called "stepping", which allows the system of golf clubs with ascending weights to be manufactured with reduced quantity of inventory.

14 Claims, 10 Drawing Sheets

(56) References Cited

U.S. PATENT DOCUMENTS

| | | | |
|---|---|---|---|
| 6,705,954 | B2 | 3/2004 | Takiguchi et al. |
| 2004/0043825 | A1 | 3/2004 | Horwood et al. |
| 2004/0102256 | A1 | 5/2004 | Kumamoto |
| 2006/0128494 | A1 | 6/2006 | Kumamoto |
| 2007/0184914 | A1 | 8/2007 | Oldenburg |
| 2010/0022324 | A1 | 1/2010 | Kato |
| 2014/0045605 | A1 | 2/2014 | Fujiwara et al. |

FOREIGN PATENT DOCUMENTS

| | | | |
|---|---|---|---|
| JP | 2004057642 | A | 2/2004 |
| JP | 2004057642 | A | 2/2004 |
| JP | 2005279098 | | 10/2005 |
| JP | 2005279098 | A | 10/2005 |

OTHER PUBLICATIONS

International Search Report and Written Opinion of the International Searching Authority for International Application No. PCT/US2016/022358 filed Mar. 6, 2016.

Tru Temper DG Spinner Wedge Plus PW/AW Tapered Shaft, http://www.amazon.com/True-Temper-Spinner-Wedge-Tapered/dp/B00KRD9B78, Date Accessed:Mar. 7, 2016.

Fig. 1

| Loft, 22 | System of Golf Clubs, 100 | | | |
|---|---|---|---|---|
| | First Set, 110 | Second Set, 120 | Third Set, 130 | Fourth Set, 140 |
| 2 | 111 | 121 | 131 | 141 |
| 3 | 112 | 122 | 132 | 142 |
| 4 | 113 | 123 | 133 | 143 |
| 5 | 114 | 124 | 134 | 144 |
| 6 | 115 | 125 | 135 | 145 |
| 7 | 116 | 126 | 136 | 146 |
| 8 | 117 | 127 | 137 | 147 |
| 9 | 118 | 128 | 138 | 148 |
| W | 119 | 129 | 139 | 149 |

Fig. 2

| Shaft Length, 38 (Inches) | Shaft Weight(grams) | | | |
|---|---|---|---|---|
| | First Set, 110 | Second Set, 120 | Third Set, 130 | Fourth Set, 140 |
| 40.5 | 90 | 100 | 108 | 118 |
| 40.0 | 92 | 102 | 110 | 121 |
| 39.5 | 94 | 104 | 112 | 123 |
| 39.0 | 96 | 106 | 114 | 125 |
| 38.5 | 98 | 108 | 116 | 127 |
| 38.0 | 100 | 110 | 118 | 129 |
| 37.5 | 102 | 112 | 120 | 129 |
| 37.0 | 104 | 114 | 122 | 129 |
| 36.5 | 106 | 116 | 124 | 130 |

Fig. 9

| Shaft Length, 38 (inches) | Shaft Weight(grams) | | | |
|---|---|---|---|---|
| | First Set, 110 | Second Set, 120 | Third Set, 130 | Fourth Set, 140 |
| 40.5 | 90 | 100 | 108 | 118 |
| 40.0 | 92 | 102 | 110 | 121 |
| 39.5 | 94 | 104 | 112 | 123 |
| 39.0 | 96 | 106 | 114 | 125 |
| 38.5 | 98 | 108 | 116 | 127 |
| 38.0 | 100 | 110 | 118 | 129 |
| 37.5 | 102 | 112 | 120 | 129 |
| 37.0 | 104 | 114 | 122 | 129 |
| 36.5 | 106 | 116 | 124 | 130 |

Fig. 10

| Shaft Length, 38 (inches) | Shaft Weight(grams) | | | |
|---|---|---|---|---|
| | First Set, 110 | Second Set, 120 | Third Set, 130 | Fourth Set, 140 |
| 40.5 | 90 | 100 | 108 | 118 |
| 40.0 | 92 | 102 | 110 | 121 |
| 39.5 | 94 | 104 | 112 | 123 |
| 39.0 | 96 | 106 | 114 | 125 |
| 38.5 | 98 | 108 | 116 | 127 |
| 38.0 | 100 | 110 | 118 | 129 |
| 37.5 | 102 | 112 | 120 | 129 |
| 37.0 | 104 | 114 | 122 | 129 |
| 36.5 | 106 | 116 | 124 | 130 |

ASCENDING WEIGHT IRON SHAFT SYSTEM

CROSS-REFERENCE TO RELATED APPLICATIONS

This claims the benefit of U.S. Provisional Patent Application No. 62/141,116, filed on Mar. 31, 2015, and U.S. Provisional Patent Application No. 62/135,301, filed on Mar. 19, 2015, the contents of which are incorporated herein by reference in their entirety.

FIELD OF INVENTION

The present disclosure relates to a system of golf clubs. In particular, the present disclosure relates to a system of iron-type golf clubs.

BACKGROUND

Typically, iron-type golf clubs are sold in sets, where each set includes golf clubs with varying loft angles and shafts that maintain stiffness for a particular level of golfer. Different sets of iron-type golf clubs generally have different stiffness classes (e.g., soft regular (SR), regular (R), stiff (S), and extra stiff (X)). Keeping stocks of varying shafts to manufacture a system of golf clubs including different stiffness classes can be expensive, as inventories have to account for weight, length, and stiffness of shafts. Accordingly, there is a need in the art for a shaft stock system that allows multiple golf clubs, having shafts with varying lengths, weights, and stiffness classes, to be manufactured with the same stock, thereby reducing the number of stocks required to be held in inventory.

BRIEF DESCRIPTION OF THE DRAWINGS

FIG. 1 illustrates a system of golf clubs with ascending weights.

FIG. 2 illustrates the shafts of the system of golf clubs in FIG. 1 with ascending weights.

FIG. 9 illustrates an example of stepping up in manufacturing the shafts of FIG. 2.

FIG. 10 illustrates an example of stepping down in manufacturing the shafts of FIG. 2.

Figure 3:
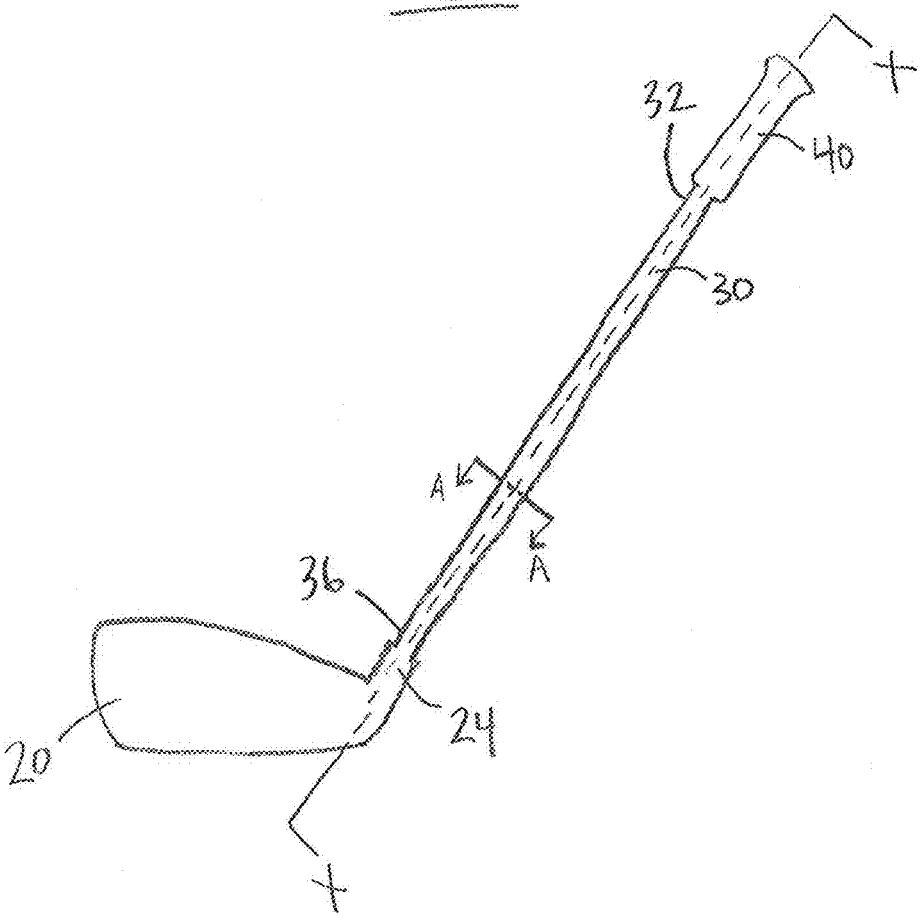
FIG. 3 illustrates a golf club within the system of golf clubs in FIG. 1.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

The inventors have discovered a system of golf clubs having shafts with ascending weights (shaft weights that increase as shaft lengths decrease) that may be manufactured by implementing a method called "stepping". Stepping allows the system of golf clubs with ascending weights to be manufactured with reduced quantity of inventory.

Definitions

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The term "constant weights" may refer to a set of iron-type golf clubs having shaft weights that remain constant as loft angles increase.

The term "descending weights" may refer to a set of iron-type golf clubs having shaft weights that decrease as loft angles increase.

The term "stiffness class" may refer to a particular set of golf clubs having shafts with flexibility designed for a particular golfer. The shafts within the particular set of golf clubs may have variations in flexibility, but on average the flexibility of the shafts within the particular set of golf clubs in a particular stiffness class are designed for a particular type of golfer.

The term "greater stiffness class" may refer to a particular set of golf clubs having golf clubs with shafts that are on average less flexible compared to the shafts of the golf clubs of a different set of golf clubs.

The term "smaller stiffness class" may refer to a particular set of golf clubs having golf clubs with shafts that are on average more flexible compared to the shafts of the golf clubs of a different set of golf clubs.

The term "first stiffness" with reference to a golf club shaft may refer to a first stiffness class, wherein the stiffness of each shaft within the first stiffness class may vary, but on average, is designed for a particular first type of golfer. The term "second stiffness" with reference to a golf club shaft may refer to a second stiffness class, wherein the stiffness of each shaft within the second stiffness class may vary, but on average, is designed for a particular second type of golfer. The term "third stiffness" with reference to a golf club shaft may refer to a third stiffness class, wherein the stiffness of each shaft within the third stiffness class may vary, but on average, is designed for a particular third type of golfer. The term "fourth stiffness" with reference to a golf club shaft may refer to a fourth stiffness class, wherein the stiffness of each shaft within the fourth stiffness class may vary, but on average, is designed for a particular fourth type of golfer. On average, the shafts having a first stiffness (in the first stiffness class) are more flexible than the shafts having a second stiffness (in the second stiffness class), the shafts having the second stiffness (in the second stiffness class) are more flexible than the shafts having a third stiffness (in the third stiffness class), the shafts having the third stiffness (in the third stiffness class) are more flexible than the shafts having a fourth stiffness (in the fourth stiffness class).

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

System of Golf Clubs

FIGS. 1-3 illustrate a system of golf clubs 100. The system of golf clubs 100 includes a plurality of golf clubs. In the illustrated embodiment, the plurality of golf clubs includes golf clubs 111-119, 121-129, 131-139, and 141-149 (hereafter, the golf clubs included within the plurality of golf clubs will be labeled 500). Each of the plurality of golf clubs 500 includes a head 20 having a loft angle 22, and a hosel 24 extending from the head 20. Each golf club 500 further includes a shaft 30 having a weight, a stiffness, a first end 32, a second end 36, and a length 38 extending from the first end 32 to the second end 36. The first end 32 of the shaft 30 is configured to receive a grip 40, and the second end 36 of the shaft 30 is configured to be positionable within the hosel 24.

Figure 4:
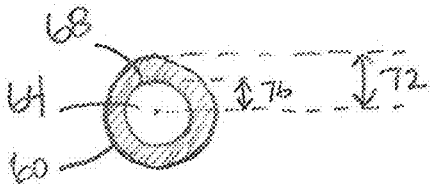
FIG. 4 illustrates a cross-sectional view of a shaft of the golf club in FIG. 3.

Referring to FIGS. 1-4, the shaft 30 further includes an exterior surface 60, a through-hole 64 defining an interior surface 68, and a longitudinal axis X extending along the length 38 and through the center of the through-hole 64 of the shaft 30. As illustrated in FIG. 4, the cross-sectional geometry of the exterior surface 60 and the interior surface 68 of the shaft 30 is circular with respect to the longitudinal axis X. The perpendicular distance from the longitudinal axis X to the exterior surface 60, at a particular location along the length 38 of the shaft 30, defines an outer diameter 72 at that particular location along the length 38 of the shaft 30. Similarly, the perpendicular distance from the longitudinal axis X to the interior surface 68 of the shaft 30, at a particular location along the length 38 of the shaft 30, defines an inner diameter 76 at that particular location along the shaft 30. The outer diameter 72 at the first end 32 of the shaft 30 is greater than the outer diameter 72 at the second end 36 of the shaft 30. Further, the shaft 30 may include various tiers (not shown), each tier having a different outer diameter 72, wherein the outer diameter 72 of the shaft 30 at each tier increases with distance from the second end 36 of the shaft 30. The thickness between the exterior surface 60 and the interior surface 68 may be consistent along the shaft longitudinal axis X. In other constructions, the thickness between the exterior surface 60 and the interior surface 68 may be variable along the shaft longitudinal axis X. The shafts 30 of each of the golf clubs 500 within the system of golf clubs 100 may be made of steel, graphite, titanium, other suitable metals, composites, or metal alloys.

With reference to FIGS. 1-2, each of the golf clubs 500 within the system of golf clubs is further categorized into at least one set of golf clubs 110, 120, 130, 140. In the illustrated embodiment, the system of golf clubs includes a first set of golf clubs 110, a second set of golf clubs 120, a third set of golf clubs 130, and a fourth set of golf clubs 140. Other embodiments of the at least one set of golf clubs may include any number of sets of golf clubs greater than or less than four.

Further with respect to FIGS. 1-2, each of the first, the second, the third, and the fourth set of golf clubs 110, 120, 130, 140 includes golf clubs 500 having golf club heads 20 with varying loft angles 22. The shafts 30 of the golf clubs 500 in each of the first, the second, the third, and the fourth set of golf clubs 110, 120, 130, 140 also have varying lengths 38. In the illustrated embodiment, the lengths 38 of the shafts 30 of the golf clubs 500 within each set of golf clubs 110, 120, 130, 140 decrease as the loft angles 22 of the respective golf clubs 500 increase. The system of golf clubs 100 in FIGS. 1-2 is an exemplary system of golf clubs 100 including exemplary shaft lengths and weights. The trends within the system of golf clubs 100 as described herein may be applied to any system of golf clubs 100 with shafts 30 having lengths 38 and weights that follow the trends described.

In the illustrated embodiment, each of the first, the second, the third, and the fourth set of golf clubs 110, 120, 130, 140 include nine golf clubs, including; a 2 iron, a 3 iron, a 4 iron, a 5 iron, a 6 iron, a 7 iron, an 8 iron, a 9 iron and a wedge. In other embodiments, each of the first, the second, the third, and the fourth set of golf clubs 110, 120, 130, 140 may include any number of golf clubs 500. Further, each of the first, the second, the third, and the fourth set of golf clubs 110, 120, 130, 140 may have the same number of golf clubs 500 or the first, the second, the third, and the fourth set of golf clubs 110, 120, 130, 140 may have a different number of golf clubs 500.

The first set of golf clubs 110 includes golf clubs 111-119 with shafts 30 having a first stiffness. The second set of golf clubs 120 includes golf clubs 121-129 with shafts 30 having a second stiffness. The third set of golf clubs 130 includes golf clubs 131-139 with shafts 30 having a third stiffness. The fourth set of golf clubs 140 includes golf clubs 141-149 with shafts having a fourth stiffness, wherein the first stiffness, the second stiffness, the third stiffness, and the fourth stiffness are all different. Specifically, in the described embodiment, the first stiffness is smaller than the second stiffness, the second stiffness is smaller than the third stiffness, and the third stiffness is smaller than the fourth stiffness. On average, the shafts having the first stiffness (in the first stiffness class) are more flexible than the shafts having the second stiffness (in the second stiffness class), the shafts having the second stiffness (in the second stiffness class) are more flexible than the shafts having the third stiffness (in the third stiffness class), the shafts having the third stiffness (in the third stiffness class) are more flexible than the shafts having the fourth stiffness (in the fourth stiffness class).

Each shaft 30 within the system of golf clubs 100 has a stiffness profile. The stiffness profile varies along the length 38 of the shaft 30 and is defined in Relation 1 below:

$$\text{Stiffness Profile} = E\frac{\pi(D_o^4 - D_i^4)}{64} \qquad \text{Relation 1}$$

Referring to Relation 1, E is the Young's Modulus, a measurement relating to material stiffness. The Young's Modulus is dependent on the material of the shaft 30. For example, the Young's Modulus of steel is approximately 200 GPa and the Young's Modulus of aluminum is approximately 69 GPa. The stiffness profile may be calculated at any particular location along the length 38 of the shaft 30 where $D_o$ is the outer diameter 72 of the shaft 30 at that particular location along the length 38 of the shaft 30, and $D_i$ is the inner diameter 76 of the shaft 30 at that particular location along the length 38 of the shaft 30.

FIGS. 11-14 illustrate exemplary stiffness profiles of the first, the second, the third, and the fourth sets of golf clubs 110, 120, 130, 140, wherein each set of golf clubs 110, 120, 130, 140 includes shafts 30 of varying lengths 38 (shown in inches ranging from 36.5-41 inches in FIGS. 11-14), and the stiffness profile of each shaft 30 within each set of golf clubs 110, 120, 130, 140 varies along the length 38 of the shaft 30.

Figure 11:
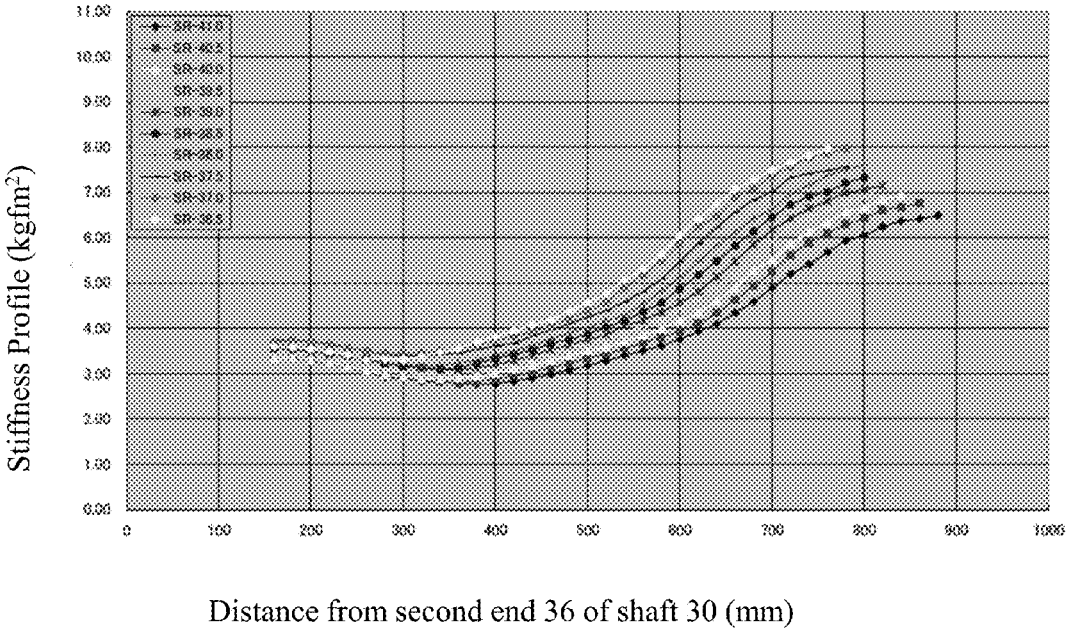
FIG. 11 illustrates exemplary stiffness profiles of a set of golf clubs.
Figure 12:
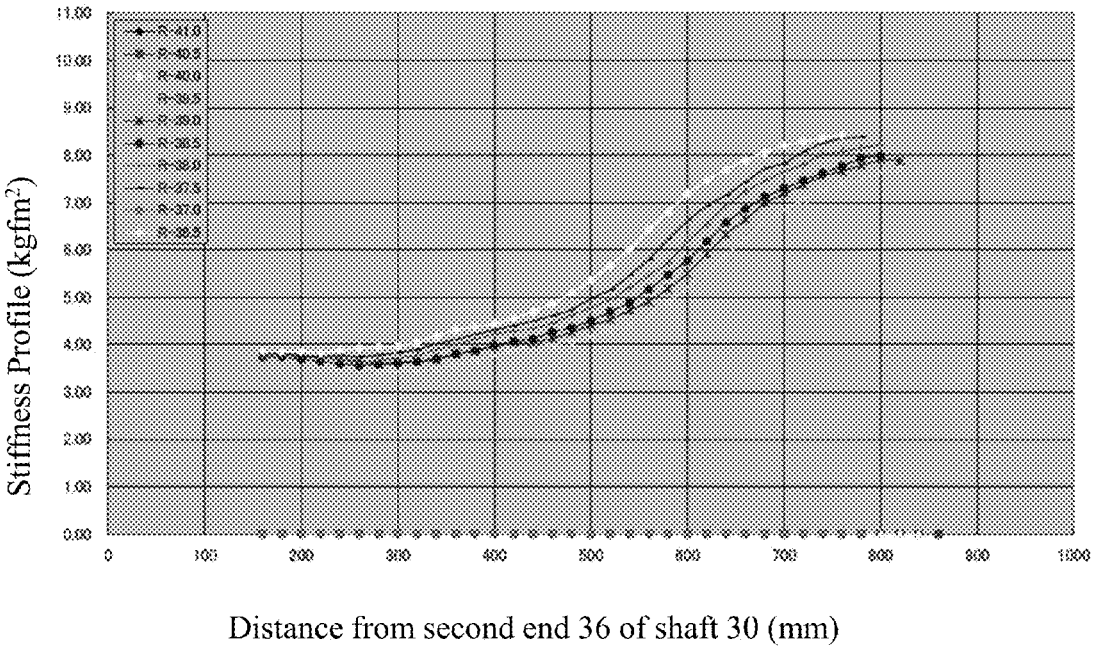
FIG. 12 illustrates exemplary stiffness profiles of another set of golf clubs.
Figure 13:
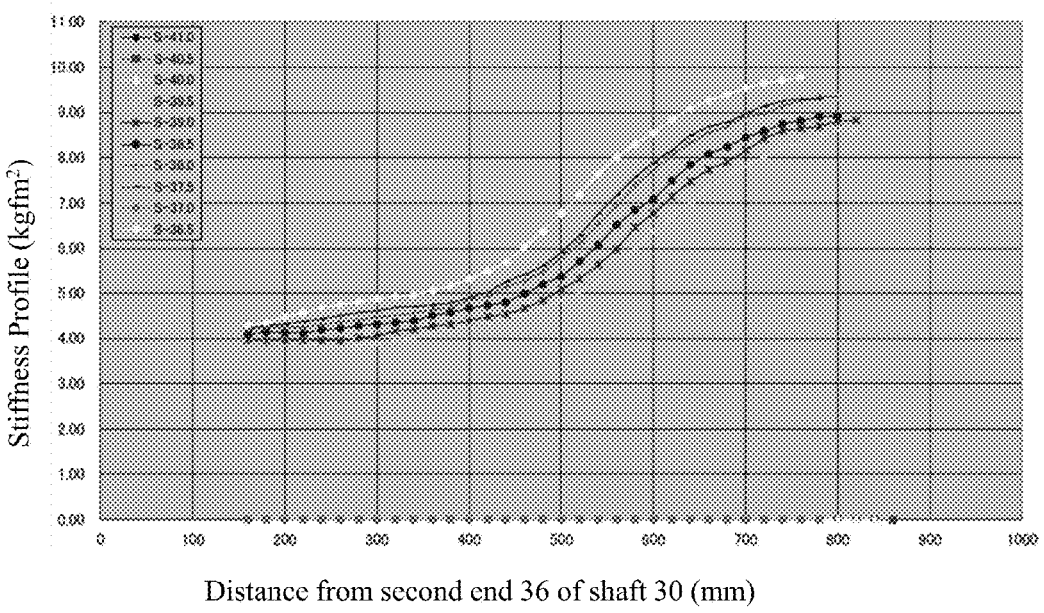
FIG. 13 illustrates exemplary stiffness profiles of another set of golf clubs.
Figure 14:
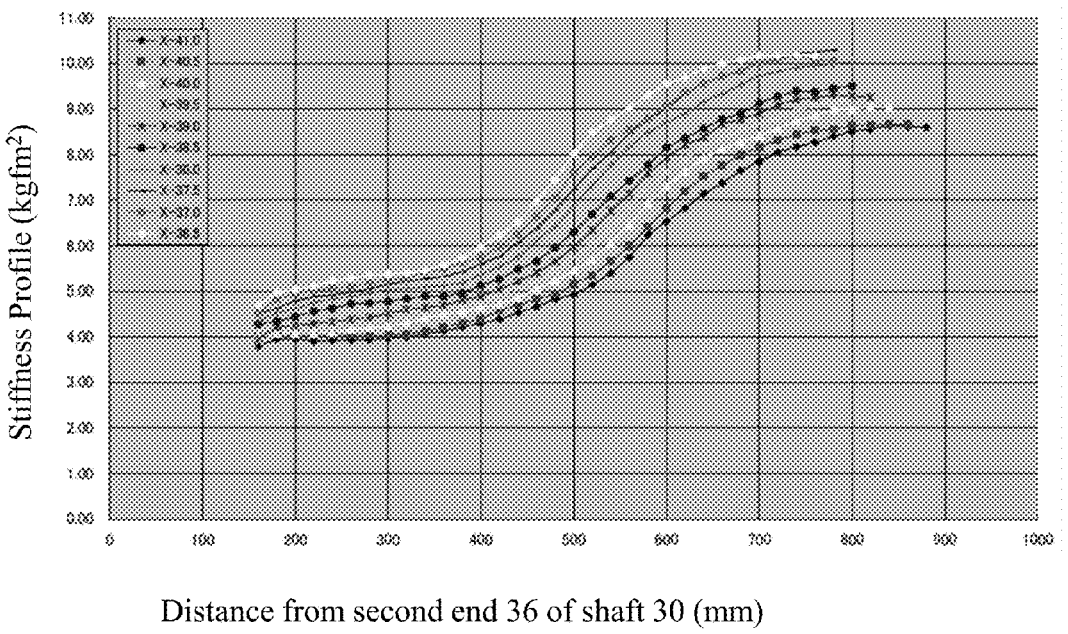
FIG. 14 illustrates exemplary stiffness profiles of another set of golf clubs.

Specifically, FIG. 11 illustrates exemplary stiffness profiles of the first set of golf clubs 110 having shafts 30 with the first stiffness, in the first stiffness class (shown as "SR"), wherein the stiffness profile ranges from a minimum of approximately 1 kgf·m$^2$ to a maximum of approximately 9.5 kgf·m$^2$. FIG. 12 illustrates exemplary stiffness profiles of the second set of golf clubs 120 having shafts 30 with the second stiffness, in the second stiffness class (shown as "R"), wherein the stiffness profile ranges from a minimum of approximately 2 kgf·m$^2$ to a maximum of approximately 10 kgf·m$^2$. FIG. 13 illustrates exemplary stiffness profiles of the third set of golf clubs 130 having shafts 30 with the third stiffness, in the third stiffness class (shown as "S"), wherein the stiffness profile ranges from a minimum of approximately 2.25 kgf·m$^2$ to a maximum of approximately 11.25 kgf·m$^2$. FIG. 14 illustrates exemplary stiffness profiles of the fourth set of golf clubs 140 having shafts 30 with the fourth stiffness, in the fourth stiffness class (shown as "X"), wherein the stiffness profile ranges from a minimum of approximately 2.5 kgf·m$^2$ to a maximum of approximately 11 kgf·m$^2$.

With reference to FIGS. 11-14, the shafts 30 within the first set of golf clubs 110 have lower stiffness profiles, on average, than the shafts 30 within the second set of golf clubs 120. The shafts 30 within the second set of golf clubs 120 have lower stiffness profiles, on average, than the shafts 30 within the third set of golf clubs 130. The shafts 30 within the third set of golf clubs 130 have lower stiffness profiles, on average, than the shafts 30 within the fourth set of golf clubs 140.

Further referring to FIGS. 1-2, each of the first, the second, the third, and the fourth set of golf clubs 110, 120, 130, 140 includes golf clubs having shafts 30 that increase in weight as the lengths 38 of the shafts decrease (hereafter, sets of golf clubs with "ascending weights"). For example, the second set of golf clubs 120 may include a first golf club 122 having a first head $\mathbf{20}_{122}$ with a first loft angle, and a first shaft $\mathbf{30}_{122}$ with a first weight and a first length. The second set of golf clubs 120 may also include a second golf club 123 having a second head $\mathbf{20}_{123}$ with a second loft angle, and a second shaft $\mathbf{30}_{123}$ with a second weight and a second length. The first set of golf clubs 110 may include a third golf club 113 having a third head $\mathbf{20}_{113}$ with a third loft angle, and a third shaft $\mathbf{30}_{113}$ with a third weight and a third length. The first set of golf clubs 110 may also include a fourth golf club 114 having a fourth head $\mathbf{20}_{114}$ with a fourth loft angle, and a fourth shaft $\mathbf{30}_{114}$ with a fourth weight and a fourth length. Further, the third set of golf clubs 130 may include a fifth golf club 131 having a fifth head $\mathbf{20}_{131}$ with a fifth loft angle, and a fifth shaft $\mathbf{30}_{131}$ with a fifth weight and a fifth length. The third set of golf clubs 130 may also include a sixth golf club 132 having a sixth head $\mathbf{20}_{132}$ with a sixth loft angle, and a sixth shaft $\mathbf{30}_{132}$ with a sixth weight and a sixth length.

Further referring to FIGS. 1-2, in the second set of golf clubs 120 with ascending weights, the second loft angle is greater than the first loft angle, the second length is less than the first length, and the second weight is greater than the first weight. In the first set of golf clubs 110 with ascending weights, the fourth loft angle is greater than the third loft angle, the fourth length is less than the third length, and the fourth weight is greater than the third weight. In the third set of golf clubs 130 with ascending weights, the sixth loft angle is greater than the fifth loft angle, the sixth length is less than the fifth length, and the sixth weight is greater than the fifth weight. As illustrated in FIGS. 1-2, this trend continues as loft angle increases within each set of golf clubs 110, 120, 130, 140. Example 1, described below, illustrates a specific system of golf clubs 100 including sets of golf clubs 110, 120, 130, 140 with ascending weights.

Typically, sets of golf clubs have constant weights or descending weights. Sets of golf clubs with constant weights and descending weights are not designed for optimal performance. Rather, sets of golf clubs with constant weights and descending weights are the result of a manufacturing process designed for simple manufacturing at a lower cost. Sets of golf clubs 110, 120, 130, 140 with ascending weights better promote desired trajectories. For example, golf clubs 500 having longer, lighter shafts 30 have less swing resistance and therefore promote faster swing speeds, resulting in higher trajectories and increased distance. Golf clubs 500 having shorter, heavier shafts 30 have greater swing resistance and therefore promote a stable feel with controlled, penetrating trajectories.

Method of Manufacturing

Figure 5:
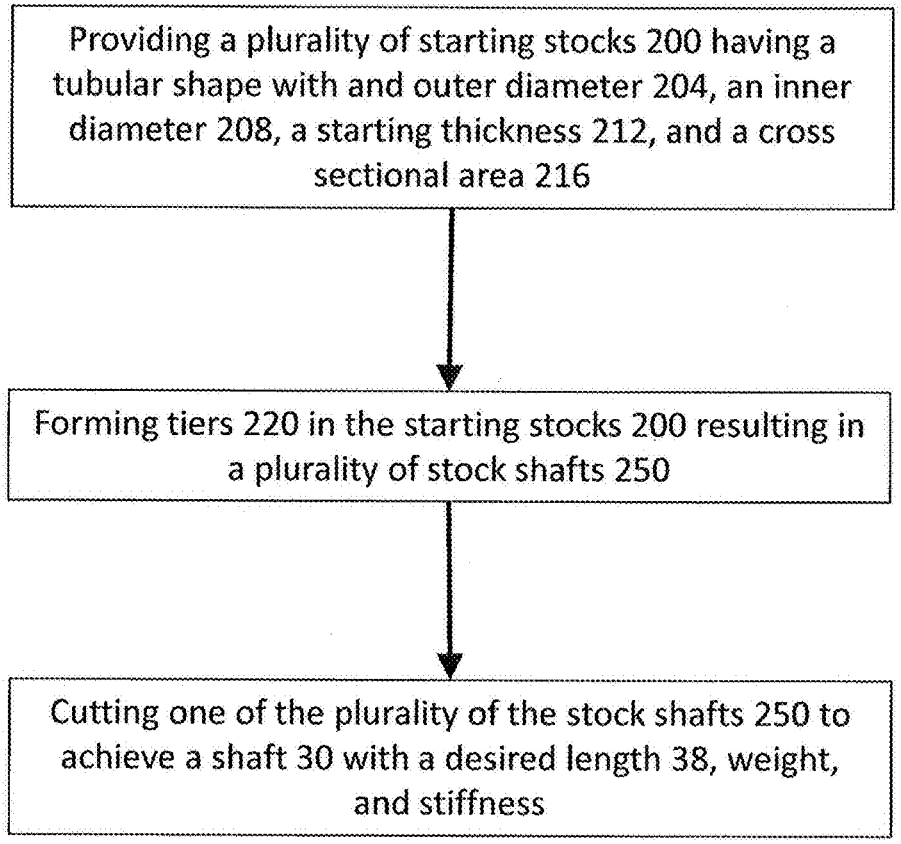
FIG. 5 illustrates a method of manufacturing the shafts in FIG. 2.
Figure 6:
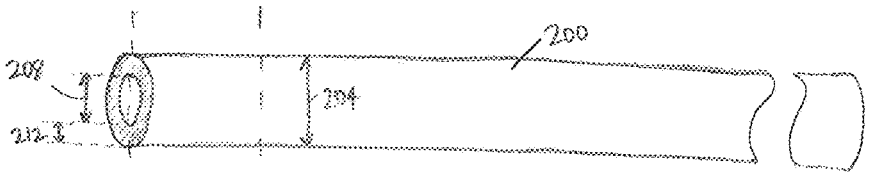
FIG. 6 illustrates a starting stock used in the method of manufacturing in FIG. 5.
Figure 7:
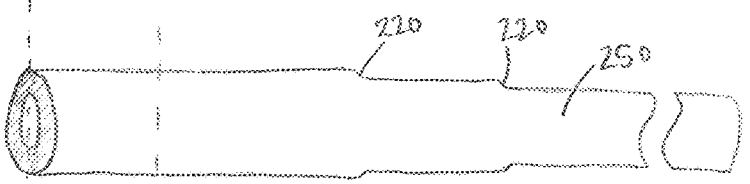
FIG. 7 illustrates a stock shaft used in the method of manufacturing in FIG. 5.
Figure 8:
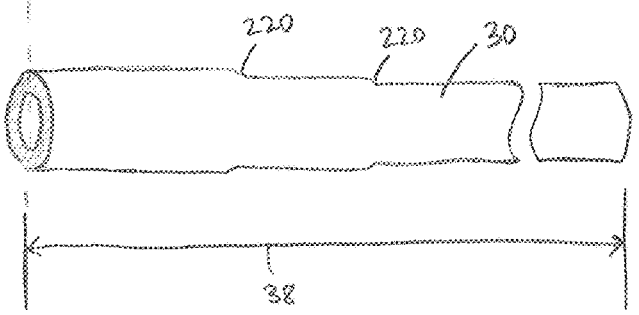
FIG. 8 illustrates a shaft used in the method of manufacturing in FIG. 5.

FIG. 5 illustrates a method of manufacturing the shafts 30 of each of the set of golf clubs 110, 120, 130, 140 within the system of golf clubs 100. The method of manufacturing the shafts 30 includes: providing a plurality of starting stocks 200 (shown in FIG. 6) having a tubular shape with an average outer diameter 204, an average inner diameter 208, and an average cross-sectional area 216, and an average weight-to-length ratio 218; forming tiers 220 in the starting stocks 200, thereby forming a plurality of stock shafts 250 (shown in FIG. 7); and (3) cutting one of the plurality of stock shafts 250, resulting in a shaft 30 (shown in FIG. 8) having a desired length, a desired weight, and belonging to a desired stiffness class. In this method of manufacturing shafts, the term "average", as it relates to the average outer diameter 204, the average inner diameter 208, the average cross-sectional area 216, and the average weight-to-length ratio 218, is defined as an average measurement taken at a plurality of evenly spaced positions along the length of the starting stocks 200.

For example, referring to FIGS. 5-8, manufacturing the first shaft $\mathbf{30}_{122}$ of the first golf club 122 within the second set of golf clubs 120 with ascending weights includes: providing a plurality of first starting stocks $\mathbf{200}_{122}$ having a tubular shape with a first average outer diameter $\mathbf{204}_{122}$, a first average inner diameter $\mathbf{208}_{122}$, a first average cross-sectional area $\mathbf{216}_{122}$, and a first average weight-to-length ratio $\mathbf{218}_{122}$; forming tiers 220 in the first starting stocks $\mathbf{200}_{122}$, thereby forming a plurality of first stock shafts $\mathbf{250}_{122}$; and cutting one of the plurality of first stock shafts $\mathbf{250}_{122}$ to the first length, resulting in a first shaft $\mathbf{30}_{122}$ having the first weight and the second stiffness. Similarly, manufacturing the second shaft $\mathbf{30}_{123}$ of the second golf club 123 within the second set of golf clubs 120 with ascending weights includes: providing a plurality of second starting stocks $\mathbf{200}_{123}$ having a tubular shape with a second average outer diameter $\mathbf{204}_{123}$, a second average inner diameter $\mathbf{208}_{123}$, a second average cross-sectional area $\mathbf{216}_{123}$, and a second average weight-to-length ratio $\mathbf{218}_{123}$ wherein the second average weight-to-length ratio $\mathbf{218}_{123}$ is greater than the first average weight-to-length ratio $\mathbf{218}_{122}$; forming tiers 220 in the second starting stocks $\mathbf{200}_{123}$, thereby forming a plurality of second stock shafts $\mathbf{250}_{123}$; and cutting one of the plurality of second stock shafts $\mathbf{250}_{123}$ to the second length, resulting in a second shaft $\mathbf{30}_{123}$ having the second weight and the second stiffness.

The above described method of manufacturing the first and the second shafts $\mathbf{30}_{122}$, $\mathbf{30}_{123}$ of the first and the second golf clubs 122, 123 may be used to manufacture the shafts 30 of any of the golf clubs 500 within the system of golf clubs 100. Further, additional processes may be added, removed or performed in any order, to optimize the properties, function, or physical appearance of the shaft 30 (e.g., heat treating, polishing, etc.). For example, composite shafts 30 may be manufactured using the method described above without forming tiers 220 in the starting stocks 200.

The shafts 30 of the golf clubs 500 within each set of golf clubs 110, 120, 130, 140, manufactured as described above, have weights that increase as the lengths of the shafts 30 decrease. This trend results in sets of golf clubs 110, 120, 130, 140 with ascending weights. For example, in manufacturing the second set of golf clubs 120 with ascending weights, the second average weight-to-length ratio $\mathbf{218}_{123}$ of the second starting stock $\mathbf{200}_{123}$ is greater than the first average weight-to-length ratio $\mathbf{218}_{122}$ of the first starting stock $\mathbf{200}_{122}$. Therefore, the second weight of the second shaft $\mathbf{30}_{123}$ is larger than the first weight of the first shaft $\mathbf{30}_{122}$.

The above described increase in average weight-to-length ratio 218 of the starting stocks 200 is necessary to manufacture sets of golf clubs 110, 120, 130, 140 with ascending weights. The increased average weight-to-length ratio 218 of the starting stocks required to achieve ascending weights may be achieved by increasing the average cross-sectional area 216 of the starting stock or by increasing the density of the starting stock (for example, by using a material having a greater density or by using a similar alloy or composite material having a different composition resulting in a greater density).

Manufacturing the shafts 30 of a set of golf clubs 110, 120, 130, 140 with ascending weights, as described above, requires different starting stocks 200 having different average weight-to-length ratios 218 for each shaft 30. For example, in the illustrated embodiment where the first, the second, the third, and the fourth set of golf clubs 110, 120, 130, 140 each include nine golf clubs, manufacturing the first set of golf clubs 110 with ascending weights requires nine different starting stocks 200. Similarly, manufacturing the second set of golf clubs 120 with ascending weights requires nine different starting stocks 200, manufacturing the third set of golf clubs 130 with ascending weights requires nine different starting stocks 200, and manufacturing the fourth set of golf clubs 140 with ascending weights requires nine different starting stocks 200.

Using different starting stocks 200 to manufacture each shaft 30 within a set of golf clubs 110, 120, 130, 140 with ascending weights requires a substantially large quantity of inventory (36 types of starting stocks 200 for the system of golf clubs 100 in the illustrated embodiment), thereby reducing manufacturing efficiency and increasing cost. To reduce the inventory, simplify manufacturing, and reduce the cost associated with manufacturing sets of golf clubs 110, 120, 130, 140 with ascending weights, a process defined herein as "stepping" may be applied. Stepping is the process of using one of the stock shafts 250 to make at least one other golf club 500 within the system of golf clubs 100 having a different length and belonging to a different stiffness class. Specifically, stepping is achieved by cutting one of the stock shafts 250 to different lengths, and assembling the resulting shafts 30 to different iron-type club heads 20 to make additional iron-type golf clubs 500 in different stiffness classes.

For example, with reference to FIG. 9, stepping may be achieved to manufacture the third golf club 113 using the plurality of first stock shafts $\mathbf{250}_{122}$ by cutting one of the plurality of first stock shafts $\mathbf{250}_{122}$ to the third length (wherein the third length is less than the first length), resulting in the third shaft $\mathbf{30}_{113}$ having the third weight (wherein the third weight is less than the first weight), and assembling the third shaft $\mathbf{30}_{113}$ to the third club head $\mathbf{20}_{113}$, resulting in the third golf club 113 having the first stiffness, the third length, and the third loft angle. In this example of stepping, the third golf club 113 may be manufactured using the plurality of first stock shafts $\mathbf{250}_{122}$, thereby eliminating the need for an additional plurality of stock shafts 250 to manufacture the third golf club 113. This example of stepping illustrates "stepping down", defined herein as using one of the plurality of stock shafts 250 to make an additional shaft 30 having a shorter length in a smaller stiffness class.

Further referring to FIG. 9, stepping down may also be achieved to manufacture the fourth golf club 114 using the plurality of second stock shafts $\mathbf{250}_{123}$ by cutting one of the plurality of second stock shafts $\mathbf{250}_{123}$ to the fourth length (wherein the fourth length is less than the second length), resulting in the fourth shaft $\mathbf{30}_{113}$ having the fourth weight (wherein the fourth weight is less than the second weight), and assembling the fourth shaft $\mathbf{30}_{113}$ to the fourth club head $\mathbf{20}_{114}$, resulting in the fourth golf club 114 having the first stiffness, the fourth length, and the fourth loft angle. In this example of stepping, the fourth golf club 114 may be manufactured using the plurality of second stock shafts $\mathbf{250}_{123}$, thereby eliminating the need for an additional plurality of fourth stock shafts 250 to manufacture the fourth golf club 114. Example 2, described below, illustrates stepping down, implemented in a specific system of golf clubs 100 including sets of golf clubs 110, 120, 130, 140 with ascending weights.

In another example, with reference to FIG. 10, stepping may be achieved to manufacture the fifth golf club 131 using the plurality of first stock shafts $\mathbf{250}_{122}$ by cutting one of the plurality of first stock shafts $\mathbf{250}_{122}$ to the fifth length (wherein the fifth length is greater than the first length), resulting in the fifth shaft $\mathbf{30}_{131}$ having the fifth weight (wherein the fifth weight is greater than the first weight), and assembling the fifth shaft $\mathbf{30}_{131}$ to the fifth club head $\mathbf{20}_{131}$, resulting in the fifth golf club 131 having the third stiffness, the fifth length, and the fifth loft angle. In this example of stepping, the fifth golf club 131 may be manufactured using the plurality of first stock shafts $\mathbf{250}_{122}$, thereby eliminating the need for an additional plurality of stock shafts 250 to manufacture the fifth golf club 131. This example of stepping illustrates "stepping up", defined herein as using one of the plurality of stock shafts 250 to make an additional shaft 30 having a longer length in a greater stiffness class.

Further referring to FIG. 10, stepping up may also be achieved to manufacture the sixth golf club 132 by cutting one of the plurality of second stock shafts $\mathbf{250}_{123}$ to the sixth length (wherein the sixth length is greater than the second length), resulting in the sixth shaft $\mathbf{30}_{132}$ having the sixth weight (wherein the sixth weight is greater than the second weight), and assembling the sixth shaft $\mathbf{30}_{132}$ to the sixth club head $\mathbf{20}_{132}$, resulting in the sixth golf club 132 having the third stiffness, the sixth length, and the sixth loft angle. In this example of stepping, the sixth golf club 132 may be manufactured using the plurality of second stock shafts $\mathbf{250}_{123}$, thereby eliminating the need for an additional plurality of stock shafts 250 to manufacture the sixth golf club 132. Example 2, described below, illustrates stepping up, implemented in a specific system of golf clubs 100 including sets of golf clubs 110, 120, 130, 140 with ascending weights.

In the described embodiment, when stepping is performed as shown in FIGS. 9 and 10 for the system of golf clubs 100 having 36 golf clubs, the inventory of starting stocks 200 is reduced from 36 starting stocks 200 to 25 starting stocks 200. Different combinations of stepping may result in a greater reduction of inventory of starting stocks 200. Further, different combinations of stepping may result in a smaller reduction in inventory of starting stocks 200.

In the described embodiment, stepping is achieved by stepping up or stepping down. While the examples in FIGS. 9-10 illustrate stepping down between the first and the second sets of golf clubs 110, 120, and stepping up between the second and third sets of golf clubs 120, 130 stepping up and stepping down may also be implemented between any combination of sets of golf clubs 110, 120, 130, 140 (for example the first and the third set of golf clubs 110, 130, the first and the fourth set of golf clubs 110, 140, the second and the third set of golf clubs 120, 130, the second and the fourth set of golf clubs 120, 140, etc.) Further, while the examples in FIGS. 9-10 illustrate stepping up and stepping down independently, stepping up and stepping down may be performed independently or in conjunction with one another for any system of golf clubs 100. Stepping cannot be implemented to achieve an additional shaft 30 having a shorter length in a greater stiffness class in the illustrated embodiment. Similarly, stepping cannot be implemented to achieve an additional shaft 30 having a longer length in a smaller stiffness class in the illustrated embodiment.

In the described embodiment, stepping is described with reference to the first, the second, the third, the fourth, the fifth, and the sixth golf clubs 122, 123, 113, 114, 131, 132. However, stepping may be applied to other combinations of golf clubs 500 within the system of golf clubs 100 that follow the trends of stepping as described herein. FIGS. 9-10 illustrate stepping within exemplary systems of golf clubs 100 having sets of golf clubs 110, 120, 130, 140 with ascending weights. However, stepping may be applied to any system of golf clubs 100 with shaft weights and shaft lengths that are different than the shaft weights and shaft lengths shown in FIGS. 9-10.

Manufacturing sets of golf clubs 110, 120, 130, 140 with ascending weights may result in shafts 30 having an undesired increase in stiffness as the weight of each shaft 30 increases within each set of golf clubs 110, 120, 130, 140. The undesired increase in stiffness results from the use of starting stocks 200 with increasing average weight-to-length ratios 218. The undesired increase in stiffness may be minimized or eliminated by altering the material of the starting stocks 200. For example, the starting stock 200 with a larger average weight-to-length ratio 218 may be made of a less stiff material to compensate for the increase in stiffness associated with the increase in average weight-to-length ratio 218. Further, the starting stock with a smaller average weight-to-length ratio 218 may be made of a stiffer material to compensate for the reduced stiffness associated with the reduced average weight-to-length ratio 218. The shafts 30 of the golf clubs 500 within each set of golf clubs 110, 120, 130, 140 may be made of the same material or different materials. Further, the shafts 30 of the golf clubs 500 within each set of golf clubs 110, 120, 130, 140 may be processed the same or differently (e.g. heat treating vs. no heat treating, heat treating for different durations, heat treating at different temperatures, etc.) to minimize the increase in stiffness with increasing average weight-to-length ratios 218 of the starting stocks 200.

Further, the undesired increase in stiffness may be minimized or eliminated by altering the cross-sectional geometries of the starting stocks 200 and/or the stock shafts 250, while maintaining a constant or increasing cross-sectional area 216, $A_c$, of the starting stocks 200 according to Relation 2 below, where Do is the outer diameter 204 of the starting stock 200 and Di is the inner diameter 208 of the starting stock 200:

$$A_c = \frac{\pi(D_o^2 - D_i^2)}{4} \qquad \text{Relation 2}$$

Specifically, the increase in stiffness may be minimized or eliminated by decreasing the outer diameter 204 and decreasing the inner diameter 208 of the starting stocks 200 as the average weight-to-length ratios 218 of the starting stocks 200 increase. Additionally, the increase in stiffness may be minimized or eliminated by increasing the outer diameter 204 and increasing the inner diameter 208 of the starting stocks 200 as the average weight-to-length ratios 218 of the starting stocks 200 increase, according to Relation 3 below, where $I_x$ is a geometric factor relating to stiffness (i.e. shaft stiffness increases as $I_x$ increases):

$$I_x = \frac{\pi(D_o^4 - D_i^4)}{64} \qquad \text{Relation 3}$$

Further, the undesired increase in stiffness may be minimized or eliminated by altering the geometry of the tiers 220 on the stock shafts 250. For example, the number of tiers 200 may be increased or decreased, the distance between the tiers 220 may be increased or decreased, the position of the tiers 220 along the stock shaft 250 may altered, or any combination of the described altered geometries, may be used to minimize the increase in stiffness of the shafts 30 with increasing average weight-to-length ratios 218 of the starting stocks 200 to achieve sets of golf clubs 110, 120, 130, 140 with ascending weights.

EXAMPLES

Example 1

Ascending Weight

An exemplary system of golf clubs 100 including four sets of golf clubs 110, 120, 130, 140 with ascending weights is provided below. The first set of golf clubs 110 of the exemplary system of golf clubs 110 includes nine golf clubs 111-119. Each of the nine golf clubs 111-119 have shafts 30 with the first stiffness. The first set of golf clubs 110 further includes; a 2-iron having a shaft $\mathbf{30}_{111}$ with a length of 40.5 inches and a weight of 90 grams, a 3-iron having a shaft $\mathbf{30}_{112}$ with a length of 40.0 inches and a weight of 92 grams, a 4-iron having a shaft $\mathbf{30}_{113}$ with a length of 39.5 inches and a weight of 94 grams, a 5-iron having a shaft $\mathbf{30}_{114}$ with a length of 39.0 inches and a weight of 96 grams, a 6-iron having a shaft $\mathbf{30}_{115}$ with a length of 38.5 inches and a weight of 98 grams, a 7-iron having a shaft $\mathbf{30}_{116}$ with a length of 38.0 inches and a weight of 100 grams, a 8-iron having a shaft $\mathbf{30}_{117}$ with a length of 37.5 inches and a weight of 102 grams, a 9-iron having a shaft $\mathbf{30}_{118}$ with a length of 37.0 inches and a weight of 104 grams, and a wedge iron having a shaft $\mathbf{30}_{119}$ with a length of 36.5 inches and a weight of 106 grams.

The second set of golf clubs 120 of the exemplary system of golf clubs 100 includes nine golf clubs 121-129. Each of the nine golf clubs 121-129 have shafts 30 with the second stiffness. The second set of golf clubs 120 further includes; a 2-iron having a shaft $\mathbf{30}_{121}$ with a length of 40.5 inches and a weight of 100 grams, a 3-iron having a shaft $\mathbf{30}_{122}$ with a length of 40.0 inches and a weight of 102 grams, a 4-iron having a shaft $\mathbf{30}_{123}$ with a length of 39.5 inches and a weight of 104 grams, a 5-iron having a shaft $\mathbf{30}_{124}$ with a length of 39.0 inches and a weight of 106 grams, a 6-iron having a shaft $\mathbf{30}_{125}$ with a length of 38.5 inches and a weight of 108 grams, a 7-iron having a shaft $\mathbf{30}_{126}$ with a length of 38.0 inches and a weight of 110 grams, a 8-iron having a shaft $\mathbf{30}_{127}$ with a length of 37.5 inches and a weight of 112 grams, a 9-iron having a shaft $\mathbf{30}_{128}$ with a length of 37.0 inches and a weight of 114 grams, and a wedge iron having a shaft $\mathbf{30}_{129}$ with a length of 36.5 inches and a weight of 116 grams.

The third set of golf clubs 130 of the exemplary system of golf clubs 100 includes nine golf clubs 131-139. Each of the nine golf clubs 131-139 have shafts 30 with the third stiffness. The third set of golf clubs 130 further includes; a 2-iron having a shaft $\mathbf{30}_{131}$ with a length of 40.5 inches and a weight of 108 grams, a 3-iron having a shaft $\mathbf{30}_{132}$ with a length of 40.0 inches and a weight of 110 grams, a 4-iron having a shaft $\mathbf{30}_{133}$ with a length of 39.5 inches and a weight of 112 grams, a 5-iron having a shaft $\mathbf{30}_{134}$ with a length of 39.0 inches and a weight of 114 grams, a 6-iron having a shaft $\mathbf{30}_{135}$ with a length of 38.5 inches and a weight of 116 grams, a 7-iron having a shaft $\mathbf{30}_{136}$ with a length of 38.0 inches and a weight of 118 grams, a 8-iron having a shaft $\mathbf{30}_{137}$ with a length of 37.5 inches and a weight of 120 grams, a 9-iron having a shaft $\mathbf{30}_{138}$ with a length of 37.0 inches and a weight of 122 grams, and a wedge iron having a shaft $\mathbf{30}_{139}$ with a length of 36.5 inches and a weight of 124 grams.

The fourth set of golf clubs 140 of the exemplary system of golf clubs 100 includes nine golf clubs 141-149. Each of the nine golf clubs 141-149 have shafts 30 with a fourth stiffness. The fourth set of golf clubs 140 further includes; a 2-iron having a shaft $\mathbf{30}_{141}$ with a length of 40.5 inches and a weight of 118 grams, a 3-iron having a shaft $\mathbf{30}_{142}$ with a length of 40.0 inches and a weight of 121 grams, a 4-iron having a shaft $\mathbf{30}_{143}$ with a length of 39.5 inches and a weight of 123 grams, a 5-iron having a shaft $\mathbf{30}_{144}$ with a length of 39.0 inches and a weight of 125 grams, a 6-iron having a shaft $\mathbf{30}_{145}$ with a length of 38.5 inches and a weight of 127 grams, a 7-iron having a shaft $\mathbf{30}_{146}$ with a length of 38.0 inches and a weight of 129 grams, a 8-iron having a shaft $\mathbf{30}_{147}$ with a length of 37.5 inches and a weight of 129 grams, a 9-iron having a shaft $\mathbf{30}_{148}$ with a length of 37.0 inches and a weight of 129 grams, and a wedge iron having a shaft $\mathbf{30}_{149}$ with a length of 36.5 inches and a weight of 130 grams.

Example 2

Stepping

An example of stepping up and stepping down within the system of golf clubs 100 of Example 1 above is described below. In this example, the first golf club 122 is a 3-iron having a shaft $\mathbf{30}_{122}$ with the second stiffness, a length of 40.0 inches and a weight of 102 grams. The second golf club 123 is a 4-iron having a shaft $\mathbf{30}_{123}$ with the second stiffness, a length of 39.5 inches, and a weight of 104 grams. The third golf club 113 is a 4-iron having a shaft $\mathbf{30}_{113}$ with the first stiffness, a length of 39.5 inches, and a weight of 94 grams. The fourth golf club 114 is a 5-iron having a shaft $\mathbf{30}_{114}$ with the first stiffness, a length of 39.0 inches, and a weight of 96 grams. The fifth golf club 131 is a 2-iron having a shaft $\mathbf{30}_{131}$ with the third stiffness, a length of 40.5 inches, and a weight of 108 grams. The sixth golf club 132 is a 3-iron having a shaft $\mathbf{30}_{132}$ with the third stiffness, a length of 40.0 inches, and a weight of 110 grams.

In the illustrated example, stepping down may be achieved by cutting one of the plurality of first stock shafts $\mathbf{250}_{122}$ to the third length of 39.5 inches, assembling the resulting shaft to a 4-iron club head, resulting in the third golf club 113, made using one of the plurality of first stock shafts $\mathbf{250}_{122}$. Stepping down may also be achieved by cutting one of the plurality of second stock shafts $\mathbf{250}_{123}$ to the fourth length of 39.0 inches, assembling the resulting shaft to a 5-iron club head, resulting in the fourth golf club 114, made using one of the plurality of second stock shafts $\mathbf{250}_{123}$.

In the illustrated example, stepping up may be achieved by cutting one of the plurality of first stock shafts $\mathbf{250}_{122}$ to the fifth length of 40.0 inches, assembling the resulting shaft to a 2-iron club head, resulting in the fifth golf club 131, made using one of the plurality of first stock shafts $\mathbf{250}_{122}$. Stepping up may also be achieved by cutting one of the plurality of second stock shafts $\mathbf{250}_{123}$ to the sixth length of 40.0 inches, assembling the resulting shaft to a 3-iron club head, resulting in the sixth golf club 132, made using one of the plurality of second stock shafts $\mathbf{250}_{123}$.

In the illustrated example, stepping is described with reference to the first golf club 122, the second golf club 123, the third golf club 113, the fourth golf club 114, the fifth golf club 131, and the sixth golf club 132. However, stepping may be applied to other combinations of golf clubs 500 within the system of golf clubs 100 that follow the trends of stepping as described in this example. Stepping cannot be implemented to achieve an additional shaft 30 having a shorter length in a greater stiffness class. Further, stepping cannot be implemented to achieve an additional shaft 30 having a longer length in a smaller stiffness class.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

Clause 1: A plurality of starting stocks for manufacturing a set of golf clubs, comprising: a plurality of first starting stocks having a first average outer diameter, a first average inner diameter, a first average cross-sectional area, and a first average weight-to-length ratio; a plurality of second starting stocks having a second average outer diameter, a second average inner diameter, a second average cross-sectional area, and a second average weight-to-length ratio, wherein the second average weight-to-length ratio is greater than the first average weight-to-length ratio; wherein one of the plurality of first starting stocks is configured to be cut to a first length, resulting in a first shaft having a first weight, the first shaft being assembled to a first club head with a first loft angle to make a first golf club in a particular stiffness class; wherein one of the plurality of second starting stocks is configured to be cut to a second length, resulting in a second shaft having a second weight, the second shaft being assembled to a second club head with a second loft angle to make a second golf club in the same stiffness class as the first golf club, wherein the second weight is greater than the first weight, the second length is less than the first length, and the second loft is greater than the first loft.

Clause 2: The plurality of starting stocks of clause 1, wherein the second average cross-sectional area is greater than or equal to the first average cross-sectional area.

Clause 3: The plurality of starting stocks of clause 1, wherein the density of the plurality of second starting stocks is greater than the density of the plurality of first starting stocks.

Clause 4: The plurality of starting stocks of clause 1, wherein the second average outer diameter of the plurality of second starting stocks is less than the first average outer diameter of the plurality of first starting stocks, the second average inner diameter of the plurality of second starting stocks is less than the first average inner diameter of the plurality of first starting stocks, and the second average cross-sectional area is greater than or equal to the first average cross-sectional area.

Clause 5: The plurality of starting stocks of clause 1, wherein the second average outer diameter of the plurality of second starting stocks is greater than the first average outer diameter of the plurality of first starting stocks, the second average inner diameter of the plurality of second starting stocks is greater than the first average inner diameter of the plurality of first starting stocks, and the second average cross-sectional area is greater than or equal to the first average cross-sectional area.

Clause 6: The plurality of starting stocks of clause 1, wherein each of the plurality of starting stocks is made of a different metal, composite or metal alloy.

Clause 7: The plurality of starting stocks of clause 1, wherein the plurality of starting stocks are made of steel, graphite, titanium, other metals, composites or metal alloys.

Clause 8: A plurality of starting stocks for manufacturing shafts of a system of golf clubs, comprising: a plurality of first starting stocks having a first average outer diameter, a first average inner diameter, a first average cross-sectional area, and first average weight-to-length ratio; a plurality of second starting stocks having a second average outer diameter, a second average inner diameter, a second average cross-sectional area, and a second average weight-to-length ratio, wherein the second average weight-to-length ratio is greater than the first average weight-to-length ratio; wherein one of the plurality of first starting stocks is configured to be cut to a first length, resulting in a first shaft having a first weight, the first shaft being assembled to a first club head with a first loft angle to make a first golf club in a particular stiffness class; wherein one of the plurality of second starting stocks is configured to be cut to a second length, resulting in a second shaft having a second weight, the second shaft being assembled to a second club head with a second loft angle to make a second golf club in the same stiffness class as the first golf club, wherein the second weight is greater than the first weight, the second length is less than first length, and the second loft is greater than the first loft; wherein one of the plurality of first starting stocks is configured to be cut to a third length, resulting in a third shaft having a third weight, the third shaft being assembled to a third club head with a third loft angle to make a third golf club in a smaller stiffness class than the first golf club, wherein third weight is less than the first weight, the third length is less than the first length and the third loft is greater than the first loft; wherein one of the plurality of second starting stocks is configured to be cut to a fourth length, resulting in a fourth shaft having a fourth weight, the fourth shaft being assembled to a fourth club head with a fourth loft angle to make a fourth golf club in a smaller stiffness class than the second golf club, wherein the fourth weight is less than the second weight, the fourth length is less than the second length and the fourth loft is greater than the first loft; wherein one of the plurality of first starting stocks is configured to be cut to a fifth length, resulting in a fifth shaft having a fifth weight, the fifth shaft being assembled to a fifth club head with a fifth loft angle to make a fifth golf club in a greater stiffness class than the first golf club, wherein the fifth weight is greater than the first weight, the fifth length is greater than the first length and the fifth loft is less than the first loft; wherein one of the plurality of second starting stocks is configured to be cut to a sixth length, resulting in a sixth shaft having a sixth weight, the sixth shaft being assembled to a sixth club head with a sixth loft angle to make a sixth golf club in a greater stiffness class than the second golf club, wherein the sixth weight is greater than the second weight, the sixth length is greater than the second length, and the sixth loft is less than the first loft.

Clause 9: The plurality of starting stocks of clause 8, wherein the second average cross-sectional area is greater than or equal to the first average cross-sectional area.

Clause 10: The plurality of starting stocks of clause 8, wherein the density of the plurality of second starting stocks is greater than the density of the plurality of first starting stocks.

Clause 11: The plurality of starting stocks of clause 8, wherein the second average outer diameter of the plurality of second starting stocks is less than the first average outer diameter of the plurality of first starting stocks, the second average inner diameter of the plurality of second starting stocks is less than the first average inner diameter of the plurality of first starting stocks, and the second average cross-sectional area is greater than or equal to the first average cross-sectional area.

Clause 12: The plurality of starting stocks of clause 8, wherein the second average outer diameter of the plurality of second starting stocks is greater than the first average outer diameter of the plurality of first starting stocks, the second average inner diameter of the plurality of second starting stocks is greater than the first average inner diameter of the plurality of first starting stocks, and the second average cross-sectional area is greater than or equal to the first average cross-sectional area.

Clause 13: The plurality of starting stocks of clause 8, wherein each of the plurality of starting stocks is made of a different metal, composite or metal alloy.

Clause 14: The plurality of starting stocks of clause 8, wherein the plurality of starting stocks are made of steel, graphite, titanium, other metals, composites, or metal alloys.

Clause 15: The plurality of starting stocks of clause 8, wherein the plurality of first starting stocks may be used to manufacture the first golf club and at least one additional golf club, the at least one additional golf club having a shaft in a different stiffness class than the shaft of the first golf club.

Clause 16: The plurality of starting stocks of clause 8, wherein the plurality of second starting stocks may be used to manufacture the second golf club and at least one additional golf club, the at least one additional golf club having a shaft in a different stiffness class than the shaft of the second golf club.

Clause 17: A method of manufacturing a system of golf clubs, the method comprising: providing a plurality of first starting stocks having a first average outer diameter, a first average inner diameter, a first average cross-sectional area, and a first average weight-to-length ratio; providing a plurality of second starting stocks having a second average outer diameter, a second average inner diameter, a second average cross-sectional area, and a second average weight-to-length ratio, wherein the second average weight-to-length ratio is greater than the first average weight-to-length ratio; cutting one of the plurality of first starting stocks to a first length, resulting in a first shaft having a first weight, assembling the first shaft to a first club head with a first loft angle to make a first golf club in a particular stiffness class; cutting one of the plurality of second starting stocks to a second length, resulting in a second shaft having a second weight, assembling the second shaft to a second club head with a second loft angle to make a second golf club in the same stiffness class as the first golf club, wherein the second weight is greater than the first weight, the second length is less than first length, and the second loft is greater than the first loft; cutting one of the plurality of first starting stocks is cut to a third length, resulting in a third shaft having a third weight, assembling the third shaft to a third club head with a third loft angle to make a third golf club in a smaller stiffness class than the first golf club, wherein the third weight is less than the first weight, the third length is less than the first length and the third loft is greater than the first loft; cutting one of the plurality of second starting stocks is cut to a fourth length, resulting in a fourth shaft having a fourth weight, assembling the fourth shaft to a fourth club head with a fourth loft angle to make a fourth golf club in a smaller stiffness class than the second golf club, wherein the fourth weight is less than the second weight, the fourth length is less than the second length and the fourth loft is greater than the first loft; cutting one of the plurality of first starting stocks is cut to a fifth length, resulting in a fifth shaft having a fifth weight, assembling the fifth shaft to a fifth club head with a fifth loft angle to make a fifth golf club in a greater stiffness class than the first golf club, wherein the fifth weight is greater than the first weight, the fifth length is greater than the first length and the fifth loft is less than the first loft; cutting one of the plurality of second starting stocks is cut to a sixth length, resulting in a sixth shaft having a sixth weight, assembling the sixth shaft to a sixth club head with a sixth loft angle to make a sixth golf club in a greater stiffness class than the second golf club, wherein the sixth weight is greater than the second weight, the sixth length is greater than the second length and the sixth loft is less than the first loft.

Clause 18: The method of manufacturing the system of golf clubs of clause 17, wherein the second average cross-sectional area is greater than or equal to the first average cross-sectional area.

Clause 19: The method of manufacturing the system of golf clubs of clause 17, wherein the density of the plurality of second starting stocks is greater than the density of the plurality of first starting stocks.

Clause 20: The method of manufacturing the system of golf clubs of clause 17, wherein the second average outer diameter of the plurality of second starting stocks is less than the first average outer diameter of the plurality of first starting stocks, the second average inner diameter of the plurality of second starting stocks is less than the first average inner diameter of the plurality of first starting stocks, and the second average cross-sectional area is greater than or equal to the first average cross-sectional area.

Clause 21: The method of manufacturing the system of golf clubs of clause 17, wherein the second average outer diameter of the plurality of second starting stocks is greater than the first average outer diameter of the plurality of first starting stocks, the second average inner diameter of the plurality of second starting stocks is greater than the first average inner diameter of the plurality of first starting stocks, and the second average cross-sectional area is greater than or equal to the first average cross-sectional area.

Clause 22: The method of manufacturing the system of golf clubs of clause 17, wherein each of the plurality of starting stocks is made of a different metal, composite or metal alloy.

Clause 23: The method of manufacturing the system of golf clubs of clause 17, wherein the plurality of starting stocks are made of steel, graphite, titanium, other metals, composites or metal alloys.

Clause 24: The method of manufacturing the system of golf clubs of claim 17, wherein the plurality of first starting stocks may be used to manufacture the first golf club and at least one additional golf club, the at least one additional golf club having a shaft in a different stiffness than the shaft of the first golf club.

Clause 25: The method of manufacturing the system of golf clubs of clause 17, wherein the plurality of second starting stocks may be used to manufacture the second golf club and at least one additional golf club, the at least one additional golf club having a shaft in a different stiffness than the shaft of the second golf club.

What is claimed is:

1. A plurality of starting stocks for manufacturing shafts of a system of golf clubs, comprising:

a plurality of first starting stocks having a first average outer diameter, a first average inner diameter, a first average cross-sectional area, and first average weight-to-length ratio;

a plurality of second starting stocks having a second average outer diameter, a second average inner diameter, a second average cross-sectional area, and a second average weight-to-length ratio, wherein the second average weight-to-length ratio is greater than the first average weight-to-length ratio;

wherein one of the plurality of first starting stocks is configured to be cut to a first length, resulting in a first shaft having a first weight, the first shaft being assembled to a first club head with a first loft angle to make a first golf club in a particular stiffness class;

wherein one of the plurality of second starting stocks is configured to be cut to a second length, resulting in a second shaft having a second weight, the second shaft being assembled to a second club head with a second loft angle to make a second golf club in the same stiffness class as the first golf club, wherein the second weight is greater than the first weight, the second length is less than the first length, and the second loft is greater than the first loft;

wherein one of the plurality of first starting stocks is configured to be cut to a third length, resulting in a third shaft having a third weight, the third shaft being assembled to a third club head with a third loft angle to make a third golf club in a smaller stiffness class than the first golf club, wherein the third weight is less than the first weight, the third length is less than the first length and the third loft is greater than the first loft;

wherein one of the plurality of second starting stocks is configured to be cut to a fourth length, resulting in a fourth shaft having a fourth weight, the fourth shaft being assembled to a fourth club head with a fourth loft angle to make a fourth golf club in a smaller stiffness class than the second golf club, wherein the fourth weight is less than the second weight, the fourth length is less than the second length and the fourth loft is greater than the first loft;

wherein one of the plurality of first starting stocks is configured to be cut to a fifth length, resulting in a fifth shaft having a fifth weight, the fifth shaft may be assembled to a fifth club head with a fifth loft angle to make a fifth golf club in a greater stiffness class than the first golf club, wherein the fifth weight is greater than the first weight, the fifth length is greater than the first length and the fifth loft is less than the first loft;

wherein one of the plurality of second starting stocks is configured to be cut to a sixth length, resulting in a sixth shaft having a sixth weight, the sixth shaft may be assembled to a sixth club head with a sixth loft angle to make a sixth golf club in a greater stiffness class than the second golf club, wherein the sixth weight is greater than the second weight, the sixth length is greater than the second length, and the sixth loft is less than the first loft.

2. The plurality of starting stocks of claim 1, wherein the second average cross-sectional area is greater than or equal to the first average cross-sectional area.

3. The plurality of starting stocks of claim 1, wherein the density of the plurality of second starting stocks is greater than the density of the plurality of first starting stocks.

4. The plurality of starting stocks of claim 1, wherein the second average outer diameter of the plurality of second starting stocks is less than the first average outer diameter of the plurality of first starting stocks, the second average inner diameter of the plurality of second starting stocks is less than the first average inner diameter of the plurality of first starting stocks, and the second average cross-sectional area is greater than or equal to the first average cross-sectional area.

5. The plurality of starting stocks of claim 1, wherein the second average outer diameter of the plurality of second starting stocks is greater than the first average outer diameter of the plurality of first starting stocks, the second average inner diameter of the plurality of second starting stocks is greater than the first average inner diameter of the plurality of first starting stocks, and the second average cross-sectional area is greater than or equal to the first average cross-sectional area.

6. The plurality of starting stocks of claim 1, wherein the plurality of first starting stocks may be used to manufacture the first golf club and at least one additional golf club, the at least one additional golf club having a shaft in a different stiffness class than the shaft of the first golf club.

7. The plurality of starting stocks of claim 1, wherein the plurality of second starting stocks may be used to manufacture the second golf club and at least one additional golf club, the at least one additional golf club having a shaft in a different stiffness class than the shaft of the second golf club.

8. A method of manufacturing a system of golf clubs, the method comprising:

providing a plurality of first starting stocks having a first average outer diameter, a first average inner diameter, a first average cross-sectional area, and a first average weight-to-length ratio;

providing a plurality of second starting stocks having a second average outer diameter, a second average inner diameter, a second average cross-sectional area, and a second average weight-to-length ratio, wherein the second average weight-to-length ratio is greater than the first average weight-to-length ratio;

cutting one of the plurality of first starting stocks to a first length, resulting in a first shaft having a first weight, assembling the first shaft to a first club head with a first loft angle to make a first golf club in a particular stiffness class;

cutting one of the plurality of second starting stocks to a second length, resulting in a second shaft having a second weight, assembling the second shaft to a second club head with a second loft angle to make a second golf club in the same stiffness class as the first golf club, wherein the second weight is greater than the first weight, the second length is less than first length, and the second loft is greater than the first loft;

cutting one of the plurality of first starting stocks is cut to a third length, resulting in a third shaft having a third weight, assembling the third shaft to a third club head with a third loft angle to make a third golf club in a smaller stiffness class than the first golf club, wherein the third weight is less than the first weight, the third length is less than the first length and the third loft is greater than the first loft;

cutting one of the plurality of second starting stocks is cut to a fourth length, resulting in a fourth shaft having a fourth weight, assembling the fourth shaft to a fourth club head with a fourth loft angle to make a fourth golf club in a smaller stiffness class than the second golf club, wherein the fourth weight is less than the second weight, the fourth length is less than the second length and the fourth loft is greater than the first loft;

cutting one of the plurality of first starting stocks is cut to a fifth length, resulting in a fifth shaft having a fifth weight, assembling the fifth shaft to a fifth club head with a fifth loft angle to make a fifth golf club in a greater stiffness class than the first golf club, wherein the fifth weight is greater than the first weight, the fifth length is greater than the first length and the fifth loft is less than the first loft;

cutting one of the plurality of second starting stocks is cut to a sixth length, resulting in a sixth shaft having a sixth weight, assembling the sixth shaft to a sixth club head with a sixth loft angle to make a sixth golf club in a greater stiffness class than the second golf club, wherein the sixth weight is greater than the second weight, the sixth length is greater than the second length and the sixth loft is less than the first loft.

9. The method of manufacturing the system of golf clubs of claim 8, wherein the second average cross-sectional area is greater than or equal to the first average cross-sectional area.

10. The method of manufacturing the system of golf clubs of claim 8, wherein the density of the plurality of second starting stocks is greater than the density of the plurality of first starting stocks.

11. The method of manufacturing the system of golf clubs of claim 8, wherein the second average outer diameter of the plurality of second starting stocks is less than the first average outer diameter of the plurality of first starting stocks, the second average inner diameter of the plurality of second starting stocks is less than the first average inner diameter of the plurality of first starting stocks, and the second average cross-sectional area is greater than or equal to the first average cross-sectional area.

12. The method of manufacturing the system of golf clubs of claim 8, wherein the second average outer diameter of the plurality of second starting stocks is greater than the first average outer diameter of the plurality of first starting stocks, the second average inner diameter of the plurality of second starting stocks is greater than the first average inner diameter of the plurality of first starting stocks, and the second average cross-sectional area is greater than or equal to the first average cross-sectional area.

13. The method of manufacturing the system of golf clubs of claim 8, wherein the plurality of first starting stocks may be used to manufacture the first golf club and at least one additional golf club, the at least one additional golf club having a shaft in a different stiffness than the shaft of the first golf club.

14. The method of manufacturing the system of golf clubs of claim 8, wherein the plurality of second starting stocks may be used to manufacture the second golf club and at least one additional golf club, the at least one additional golf club having a shaft in a different stiffness than the shaft of the second golf club.

* * * * *